US007050074B1

(12) United States Patent
Koyama

(10) Patent No.: US 7,050,074 B1
(45) Date of Patent: May 23, 2006

(54) COLOR CORRECTION IN IMAGE DISPLAY

(75) Inventor: Fumio Koyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 341 days.

(21) Appl. No.: 09/592,734

(22) Filed: Jun. 13, 2000

(30) Foreign Application Priority Data

Jun. 18, 1999 (JP) ..... 11-172254

(51) Int. Cl.
*G09G 5/10* (2006.01)
*G09G 5/02* (2006.01)

(52) U.S. Cl. ..... 345/690; 345/589

(58) Field of Classification Search ..... 348/745, 348/223, 381; 345/601, 611, 602, 690, 88
See application file for complete search history.

(56) References Cited

U.S. PATENT DOCUMENTS 5,047,861 A * 9/1991 Houchin et al. ..... 348/247
5,260,797 A * 11/1993 Muraji et al. ..... 348/745
5,289,286 A * 2/1994 Nakamura et al. ..... 348/223.1
5,293,224 A * 3/1994 Ajima ..... 348/656
5,359,342 A 10/1994 Nakai et al. ..... 345/89
5,452,019 A * 9/1995 Fukuda et al. ..... 348/655
5,452,109 A * 9/1995 Compton ..... 358/482
5,483,259 A * 1/1996 Sachs ..... 345/600
5,510,851 A * 4/1996 Foley et al. ..... 348/658
5,539,459 A * 7/1996 Bullitt et al. ..... 348/254
5,784,100 A * 7/1998 Konishi ..... 348/251
5,793,344 A * 8/1998 Koyama ..... 345/87
5,796,430 A * 8/1998 Katoh et al. ..... 348/246
5,838,396 A * 11/1998 Shiota et al. ..... 348/745
5,883,476 A * 3/1999 Noguchi et al. ..... 315/368.12
5,949,400 A * 9/1999 Kim ..... 345/690
6,043,797 A * 3/2000 Clifton et al. ..... 345/589
6,081,254 A * 6/2000 Tanaka et al. ..... 382/167
6,549,183 B1 * 4/2003 Koyama ..... 345/92
6,704,008 B1 * 3/2004 Naito et al. ..... 345/207

FOREIGN PATENT DOCUMENTS

EP 0 402 137 12/1990
JP 11-113019 4/1999

OTHER PUBLICATIONS

Patent Abstracts of Japan, JP 11-113019, Apr. 23, 1999.
Patent Abstracts of Japan, JP 05-197357, Aug. 6, 1993.

* cited by examiner

*Primary Examiner*—Ryan Yang
(74) *Attorney, Agent, or Firm*—Oblon, Spivak, McClelland, Maier & Neustadt, P.C.

(57) ABSTRACT

The image display apparatus comprises: an image processor for outputting image data including plural color component data; a gain corrector for correcting levels of the image data output by the image processor; and an image display device having a plurality of pixels from each of whose pixels light for forming an image exits in accordance with the corrected image data corrected by the gain corrector. The gain corrector corrects the level of at least one of the plural color component data applied to the pixels in accordance with the positions of the pixels such that, when image data representing an image of a prescribed uniform color are output from the image processor, difference in chromaticity of light exiting from the pixels is reduced among the pixels without making luminance of the light exiting from the pixels of the image display device the same at all pixels.

28 Claims, 10 Drawing Sheets

*Fig.8*

| AREA | RED GAIN | BLUE GAIN |
|---|---|---|
| 1 | gr=ar1·x+br1·y+cr1<br>ar1=(gBr-gAr)/X01<br>br1=(gDr-gAr)/Y01<br>cr1=gAr<br>X01=XB-0, Y01=YD-0 | gb=ab1·x+bb1·y+cb1<br>ab1=(gBb-gAb)/X01<br>bb1=(gDb-gAb)/Y01<br>cb1=gAb<br>X01=XB-0, Y01=YD-0 |
| 2 | gr=ar2·x+br2·y+cr2<br>ar2=(gEr-gDr)/X01<br>br2=(gEr-gBr)/Y01<br>cr2=gDr+gBr-gEr<br>X01=XB-0, Y01=YD-0 | gb=ab2·x+bb2·y+cb2<br>ab2=(gEb-gDb)/X01<br>bb2=(gEb-gBb)/Y01<br>cb2=gDb+gBb-gEb<br>X01=XB-0, Y01=YD-0 |
| 3 | gr=ar3·x+br3·y+cr3<br>ar3=(gFr-gEr)/X02<br>br3=(gEr-gBr)/Y02<br>cr3=gBr<br>X02=XC-XB, Y02=YD-0 | gb=ab3·x+bb3·y+cb3<br>ab3=(gFb-gEb)/X02<br>bb3=(gEb-gBb)/Y02<br>cb3=gBb<br>X02=XC-XB, Y02=YD-0 |
| 4 | gr=ar4·x+br4·y+cr4<br>ar4=(gCr-gBr)/X02<br>br4=(gFr-gCr)/Y02<br>cr4=gBr<br>X02=XC-XB, Y02=YD-0 | gb=ab4·x+bb4·y+cb4<br>ab4=(gCb-gBb)/X02<br>bb4=(gFb-gCb)/Y02<br>cb4=gBb<br>X02=XC-XB, Y02=YD-0 |
| 5 | gr=ar5·x+br5·y+cr5<br>ar5=(gHr-gGr)/X03<br>br5=(gGr-gDr)/Y03<br>cr5=gDr<br>X03=XB-0, Y03=YG-YD | gb=ab5·x+bb5·y+cb5<br>ab5=(gHb-gGb)/X03<br>bb5=(gGb-gDb)/Y03<br>cb5=gDb<br>X03=XB-0, Y03=YG-YD |
| 6 | gr=ar6·x+br6·y+cr6<br>ar6=(gEr-gDr)/X03<br>br6=(gHr-gEr)/Y03<br>cr6=gDr<br>X03=XB-0, Y03=YG-YD | gb=ab6·x+bbr6·y+cb6<br>ab6=(gEb-gDb)/X03<br>bb6=(gHb-gEb)/Y03<br>cb6=gDr<br>X03=XB-0, Y03=YG-YD |
| 7 | gr=ar7·x+br7·y+cr7<br>ar7=(gFr-gEr)/X04<br>br7=(gHr-gEr)/Y04<br>cr7=gEr<br>X04=XC-XB, Y04=YG-YD | gb=ab7·x+bb7·y+cb7<br>ab7=(gFb-gEb)/X04<br>bb7=(gHb-gEb)/Y04<br>cb7=gEb<br>X04=XC-XB, Y04=YG-YD |
| 8 | gr=ar8·x+br8·y+cr8<br>ar8=(glr-gHr)/X04<br>br8=(glr-gFr)/Y04<br>cr8=gHr+gFr-glr<br>X04=XC-XB, Y04=YG-YD | gb=ab8·x+bb8·y+cb8<br>ab8=(glb-gHb)/X04<br>bb8=(glb-gFb)/Y04<br>cb8=gHb+gFb-glb<br>X04=XC-XB, Y04=YG-YD |

COLOR CORRECTION IN IMAGE DISPLAY

BACKGROUND OF THE INVENTION

1. Field of the Invention

The present invention relates to an image display for displaying color images.

2. Description of the Related Art

Various types of displays have been developed for displaying color images, including the direct viewing and projection types. The direct viewing display uses a liquid crystal panel, plasma display panel (PDP), CRT or the like to display an image that the viewer views directly. The projection display is equipped with a projection lens, various optical systems and a display device such as a liquid crystal panel, digital micromirror device (DMD, trademark of Texas Instruments Inc.) or CRT. An image formed on the display device is projected onto a screen, for instance, for viewing.

Ideally, the image displayed by a color display is uniform, i.e., totally free of unevenness. Actually, however, unevenness sometimes arises in the displayed image for reasons that will now be discussed.

When a liquid crystal panel is used as the display device, image data are applied to the individual pixels of the liquid crystal panel to vary the transmittance and reflectance of the pixels with respect to illumination light projected onto the panel. The light projected onto the panel exits from the panel as image-bearing light. To ensure that images are displayed with no unevenness, the transmittance and reflectance characteristics of the liquid crystal should be the same at every pixel. In an actual liquid crystal panel, however, they vary to some extent. The color of the displayed image is therefore sometimes uneven. Color unevenness also occurs when other types of display devices are used, owing to non-uniformity of the various display device characteristics.

Display devices like the liquid crystal panel and the digital micromirror device require a separate optical system for projecting illumination light. Color unevenness may be produced in the displayed image depending on the luminance and color distribution of the light from the illumination optical system.

In the case of a projection display, color unevenness sometimes arises in the displayed image for reasons related to the characteristics of the display's various optical systems.

SUMMARY OF THE INVENTION

Accordingly, an object of the present invention is to provide a technology for suppressing color unevenness in displayed images.

In order to attain at least one of the above and other objects of the present invention, there is provided an image display apparatus. The apparatus comprises: an image processor for outputting image data including plural color component data; a gain corrector for correcting levels of the image data output by the image processor; and an image display device having a plurality of pixels from each of whose pixels light for forming an image exits in accordance with the corrected image data corrected by the gain corrector. The gain corrector corrects the level of at least one of the plural color component data applied to the pixels in accordance with the positions of the pixels such that, when image data representing an image of a uniform color are output from the image processor, difference in chromaticity of light exiting from the pixels is reduced among the pixels without making luminance of the light exiting from the pixels of the image display device the same at all pixels.

The image display apparatus can reduce color unevenness of the displayed image because, when the image processing unit outputs image data representing a uniform image of a prescribed color, the level of the image data applied to the individual pixels in accordance with their positions in the image display device is corrected to reduce difference in chromaticity of exiting light among the pixels.

In one embodiment, the gain corrector corrects the levels of all but a specific one of the plural color component data applied to the pixels to reduce difference in level between the specific color component data and the other color component data.

This configuration reduces difference in chromaticity of exiting light among the pixels without making the luminance of the light exiting from the pixels of the image display device the same at all pixels.

The specific color component data may be the type of color component data that makes the greatest contribution to the luminance of the light for forming the image.

This configuration suppresses color unevenness while also suppressing to some extent scatter in the luminance of the light for forming the image-bearing light exiting from the pixels.

When the plural color component data are red, green and blue component data and the specific color component data may be the green component data.

Among red, green and blue, green makes the greatest contribution to luminance. This configuration therefore suppresses color unevenness while also suppressing to some extent scatter in the luminance of the light for forming the image-bearing light exiting from the pixels.

The plurality of pixels may be segmented into a plurality of small areas of polygonal shape. In this case, correction values for apex pixels corresponding to apexes of the small blocks are determined in advance, and correction values of pixels other than the apex pixels in each small areas are interpolated from the correction values of the apex pixels of the small area.

This configuration enables the correction values of the pixels in each small area to be interpolated from apex pixel correction values calculated in advance. The number of pixels whose correction values are calculated in advance can therefore be reduced. As a result, the operations for calculating correction values in advance can be simplified and the device for storing the data representing the calculated correction values can also be simplified.

The plurality of pixels may segmented into the plurality of small areas by drawing a horizontal line through a center pixel among the multiple pixels, drawing a vertical line through the center pixel, and drawing the sides of a rhombus whose apexes are the extremities of the horizontal line and the vertical line.

Color unevenness generally has a distribution spreading from the center to the periphery of the image. This configuration effectively suppresses color unevenness distributed in this manner.

The present invention can be implemented in various ways, such as image display apparatus and method, a computer program therefor, a computer program product including the computer program, a data signal embodied in a carrier wave including the computer program.

These and other objects, features, aspects, and advantages of the present invention will become more apparent from the following detailed description of the preferred embodiments with the accompanying drawings.

BRIEF DESCRIPTION OF THE DRAWINGS

FIG. 8 is diagram concerning the areas for explaining examples of correction gain interpolation equations and constants stored in a constant table 220A.

DESCRIPTION OF THE PREFERRED EMBODIMENTS

Figure 1:
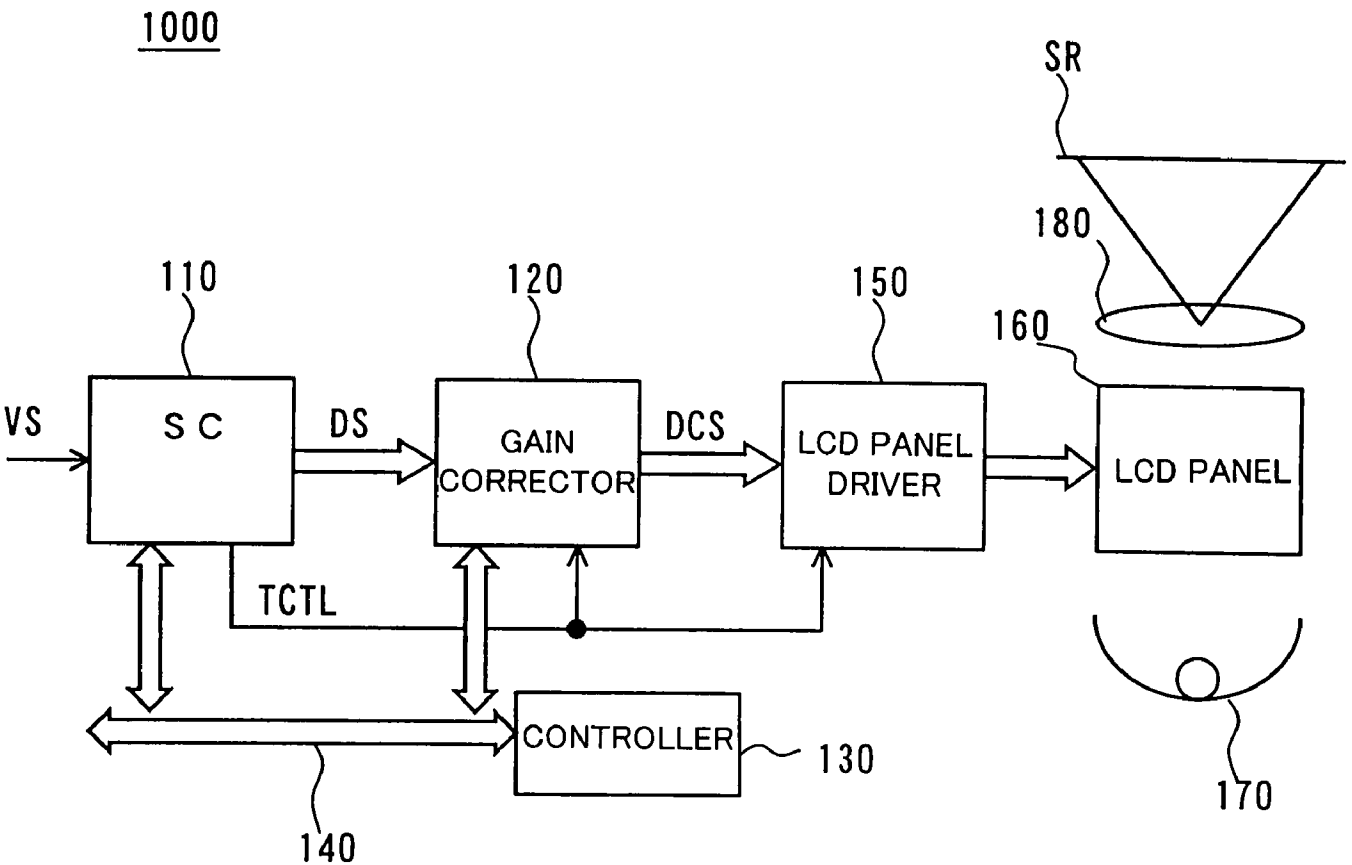
FIG. 1 is a block diagram schematically illustrating an image display 1000 that is a first embodiment of this invention.

A. First embodiment:

FIG. 1 is a block diagram schematically illustrating an image display 1000 that is a first embodiment of this invention. The image display 1000 comprises a scan converter (SC) 110, a gain corrector 120, a controller 130, a liquid crystal panel driver 150, liquid crystal panels 160, an illumination optical system 170 and a projection optical system 180. The image display 1000 is a projector which displays images by projecting red, green and yellow light exiting from the liquid crystal panels 160 at every pixel onto a projection screen SR through the projection optical system 180. The structures of the liquid crystal panel 160, illumination optical system 170 and projection optical system 180 are described in assignee's Japanese Patent Laid-Open Gazette No. 10-171045, the disclosure of which is incorporated herein by reference for all purposes.

The controller 130 is connected to the SC 110 and the gain corrector 120 through a bus 140. The controller 130 sets the processing conditions of the different sections and directly controls the processing of every section.

The SC 110 outputs a timing signal TCTL used to form an image on the liquid crystal panel 160. The timing signal TCTL ordinarily includes a vertical synchronizing signal VD, a horizontal synchronizing signal HD and a clock signal DCLK. The SC 110 also outputs a given image signal VS as an image signal DS in a form suitable for input to the liquid crystal panel 160. The image data composing the image signal DS include one 24-bit data set for each pixel. The data sets are output serially pixel by pixel. The image data set of each pixel consists of 8 bits of color data for each of red, green and blue. For convenience in explanation, the image data contained in the image signal DS will hereafter sometimes be referred to as "image data DS."

As explained in further detail later, the gain corrector 120 subjects the image signal DS received from the SC 110 to gain correction in accordance with the positions of the pixels. The gain-corrected image data DCS is supplied to the liquid crystal panel driver 150. The liquid crystal panel driver 150 supplies the image data DCS to the liquid crystal panel 160 under timing control by the timing signal TCTL. The liquid crystal panel 160 modulates illumination light from the illumination optical system 170 in accordance with the supplied image data DCS. The projection optical system 180 projects the light modulated by the liquid crystal panel 160 onto the projection screen SR, thereby displaying an image.

The liquid crystal panel 160 thus corresponds to the image display device of the present invention, while the SC 110 corresponds to the image processor of the invention and the gain corrector 120 corresponds to the gain corrector of the invention.

Figure 2:
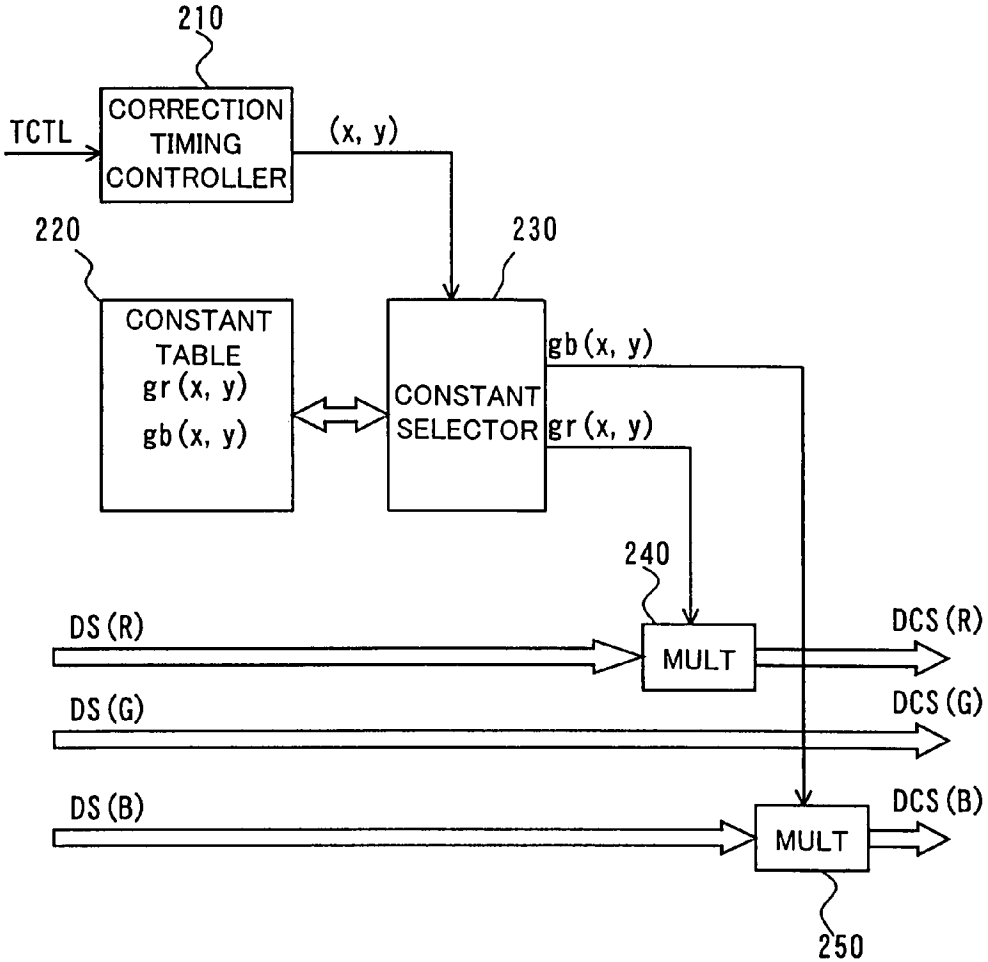
FIG. 2 is a block diagram schematically illustrating a gain corrector 120.
Figure 3A:
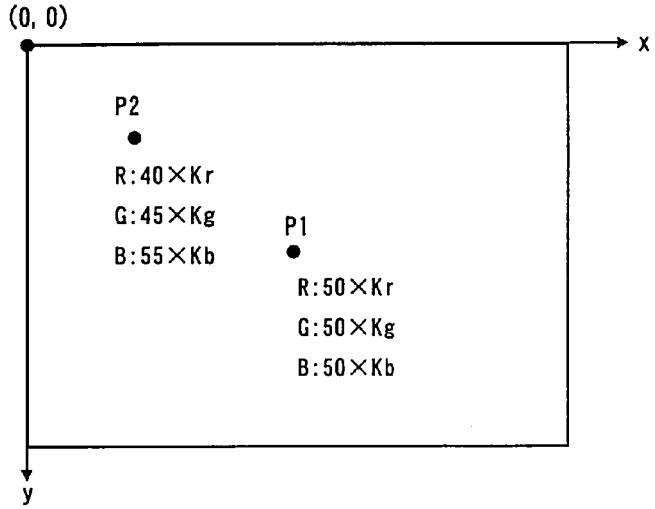
FIGS. 3(A) and 3(B) show color unevenness correction.

FIG. 2 is a block diagram schematically illustrating the gain corrector 120. The gain corrector 120 comprises a correction timing controller 210, a constant table 220, a constant selector 230, a red multiplier 240 and a blue multiplier 250. The constant table 220 stores red and blue correction gains gr(x, y) and gb(x, y) for each pixel. As shown in FIG. 3(A), the position of each pixel of the liquid crystal panel, which comprises multiple pixels in a matrix array, is defined by the value of (x, y) in an orthogonal coordinate system whose origin (0, 0) is defined as the pixel at the left edge in the horizontal direction and the upper edge in the vertical direction; x represents position in the horizontal direction and y position in the vertical direction.

The correction timing controller 210 uses the given timing signal TCTL to calculate the position (x, y) of the pixel to which the image data DS received from the SC 110 is to be applied. The constant selector 230 selects the correction gains gr(x, y), gb(x, y) corresponding to the calculated pixel position (x, y) from the constant table 220 and supplies the red correction gain gr(x, y) to the red multiplier 240 and the correction gain gb(x, y) to blue multiplier 250.

The red multiplier 240 multiplies the input red image data DS(R) by gr(x, y) and outputs the product as red image data DCS(R). The blue multiplier 250 multiplies the input blue image data DS(B) by gb(x, y) and outputs the product as blue image data DCS(B). The green image data DS(G) is output unchanged as image data DCS(G).

In the image display 1000, since the image represented by the image data DCS corrected by the gain corrector 120 is formed on the liquid crystal panel 160, the color unevenness that tends to arise in the displayed image can be suppressed as explained in the following.

Figure 3B:
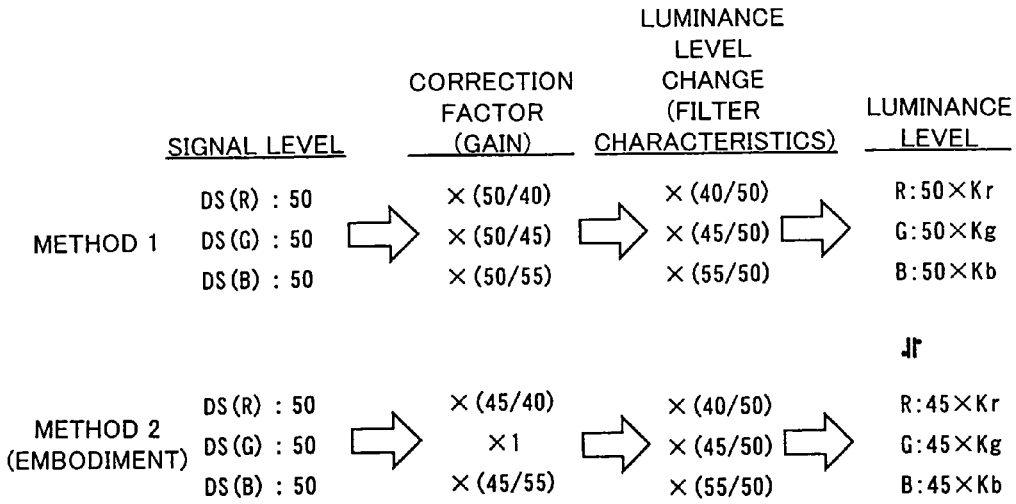

FIGS. 3(A) and 3(B) illustrate methods of color unevenness correction. To make the explanation easier, the levels of the color image data are defined as falling between 0 and 100. The red luminance level range is defined as 0 Kr to 100 Kr, the green luminance level range as 0 Kg to 100 Kg, and the blue luminance level range as 0 Kb to 100 Kb. The coefficients Kr, Kg and Kb indicate the contribution of the light of the color concerned to the luminance of light exiting from the pixels. Their values are Kr≈0.299, Kg≈0.587 and Kb≈0.114. If red, green and blue each has an image data level of 50, representing a gray image, the red, green and blue luminance levels of the image to be displayed are defined as 50 Kr, 50 Kg and 50 Kb.

FIG. 3(A) illustrates occurrence of color unevenness in the case of applying the pixels with gray image data, i.e., image data in which each of red, green and blue has a level of 50. Specifically, the red, green and blue luminance levels at pixel P1 are 50 Kr, 50 Kg and 50 Kb, which are the color luminance levels that should be displayed, but at pixel P2 the luminance level of red is 40 Kr, the luminance level of green is 45 Kg, and the luminance level of blue is 55 Kb, because of the characteristics of the pixel P2. Color unevenness is therefore present.

The situation is equivalent to a filter that multiplies red by (40/50), green by (45/50) and blue by (55/50) being present at pixel P2. This leads to the conclusion that the color unevenness of FIG. 3(A) can be suppressed by Method 1 shown in FIG. 3(B). In Method 1, the image data levels are corrected in advance so as to cancel out the luminance level changes produced by the equivalent filter. Specifically, the red, green and blue image data sets are multiplied by the reciprocals of the respective equivalent filter color gains (40/50), (45/50) and (55/50), i.e., by (50/40), (50/45) and (50/55). By this, the luminance levels disregarding the coefficients, (hereafter referred to simply as "luminance levels") are corrected to 50 for all colors. As Method 1 can correct the luminance level of each color to its proper value, it can suppress color unevenness. Correction by Method 1 is complicated, however, because the image data sets for all possible colors have to be corrected.

In the present embodiment, therefore, color unevenness is suppressed by Method 2. Method 2 defines the luminance level of green as a reference and effects correction for making the luminance levels of red and blue equal to that of green. Specifically, the red image data set is multiplied by the ratio of the green luminance level to the red luminance level (45/40), and the blue image data set is multiplied by the ratio of the green luminance level to the blue luminance level (45/55), thus making the luminance level of all colors equal to the green luminance level of 45.

Hue and saturation of each color can be defined by chromaticity. In suppressing color unevenness, therefore, it suffices to make the chromaticity of the pixels experiencing color unevenness equal to the proper chromaticity. Taking only chromaticity into consideration, one can see that among lights differing in luminance there exist ones that are the same in chromaticity. For instance, the chromaticity of light whose individual colors have a luminance of 50 and the chromaticity of light whose individual colors have a luminance of 45 are in principle the same and the two lights are displayed as the same color, notwithstanding that they differ in luminance. In other words, Method 2 suppresses color unevenness by effecting correction of the image data applied to the pixels so that, when an image of uniform color is displayed, all pixels are made equal in color irrespective of change in luminance level. Although Method 2 may result in luminance scatter (luminance unevenness), it can achieve the same suppression of color unevenness as Method 1. Unlike Method 1, which requires correction of three sets of color data for suppression of color unevenness, Method 2 requires correction of only two color data sets and is therefore advantageous to Method 1 in ease of correction. Moreover, Method 2 can be implemented using a gain corrector that is structurally simpler than would be needed for implementing Method 1.

As was noted above, Method 2 may produce luminance unevenness. As explained in the following, however, this is not a problem in practical application.

The human eye is less sensitive to luminance unevenness than color unevenness. Further, while it is somewhat sensitive to changes in the luminance level of light from nearby sources, it is insensitive to changes in the luminance level of light from relatively distant sources. As color unevenness generally has a rather gradual distribution, the luminance unevenness caused by the changes in luminance produced when color unevenness is suppressed by Method 2 therefore also has a rather gradual distribution. Luminance unevenness is therefore not strongly perceived. Furthermore, as was pointed out earlier, the rates at which red, green and blue contribute to the luminance of the light exiting from the pixels are Kr≈0.299, Kg≈0.587 and Kb≈0.114, with the contribution of green being the greatest. Since Method 2 defines green, the color making the largest contribution to luminance, as the reference, it holds the effect of luminance change to the very minimum. For the foregoing reasons, luminance unevenness produced by Method 2 causes substantially no problem in practical application.

Method 2 was explained with regard to the case of adjusting the luminance levels of red and blue light to the luminance level of green light but either red or blue can be used the reference instead. Still, in view of the fact that green has the greatest effect on luminance among the three colors, green is preferably adopted as the reference. In a case where color images are formed using a combination of colors other than the three primary colors (red, green and blue), the same effects can be obtained by selecting one of the colors as a reference, particularly by selecting the color among them that has the greatest effect on luminance.

The correction gains gr(x, y) and gb(x, y) stored in the constant table 220 correspond to the ratio of pixel green luminance level to red luminance level and the ratio of pixel green luminance level to blue luminance level in Method 2. The gains are determined in the following manner:

i) Image data representing a uniform gray image are output from the SC 110.

ii) The chromaticity of each pixel is measured while varying the correction gains gr and gb applied to the multipliers 240 and 250 (FIG. 2) until the chromaticity of the pixel becomes equal to the proper gray chromaticity to be displayed.

iii) The correction gains gr and gb when the chromaticity of the pixel becomes equal to the proper gray chromaticity are stored in the constant table 220 as gr(x, y) and gb(x, y) for position (x, y) of the pixel.

The procedure for determining the correction gains is not limited to the steps i) to iii) set out above. In i), an image of a color other than gray can be displayed instead of the uniform gray image. However, the image should preferable be of a color including red, green blue. Although the chromaticity of every pixel is measured in ii), the procedure is not limited to this. For example, it is possible instead to measure the chromaticity of a pixel region consisting of multiple pixels including a prescribed pixel to be measured and to use the measured chromaticity as the chromaticity of the prescribed pixel. This method is convenient because it is difficult to measure the chromaticity of individual pixels. Any procedure can be adopted that, during display of an image of uniform color, enables the correction gains of every pixel to be determined so as to reduce any difference between the chromaticity of the pixel and the chromaticity of the color desired to be displayed.

As explained in the forgoing, the image display 1000 according to this embodiment is configured so that, during display of an image of uniform color, the image data supplied to the liquid crystal panel 160 can be corrected in the gain corrector 120 so that the light exiting from every pixel is made to have the same chromaticity. It can therefore suppress color unevenness.

Figure 4:
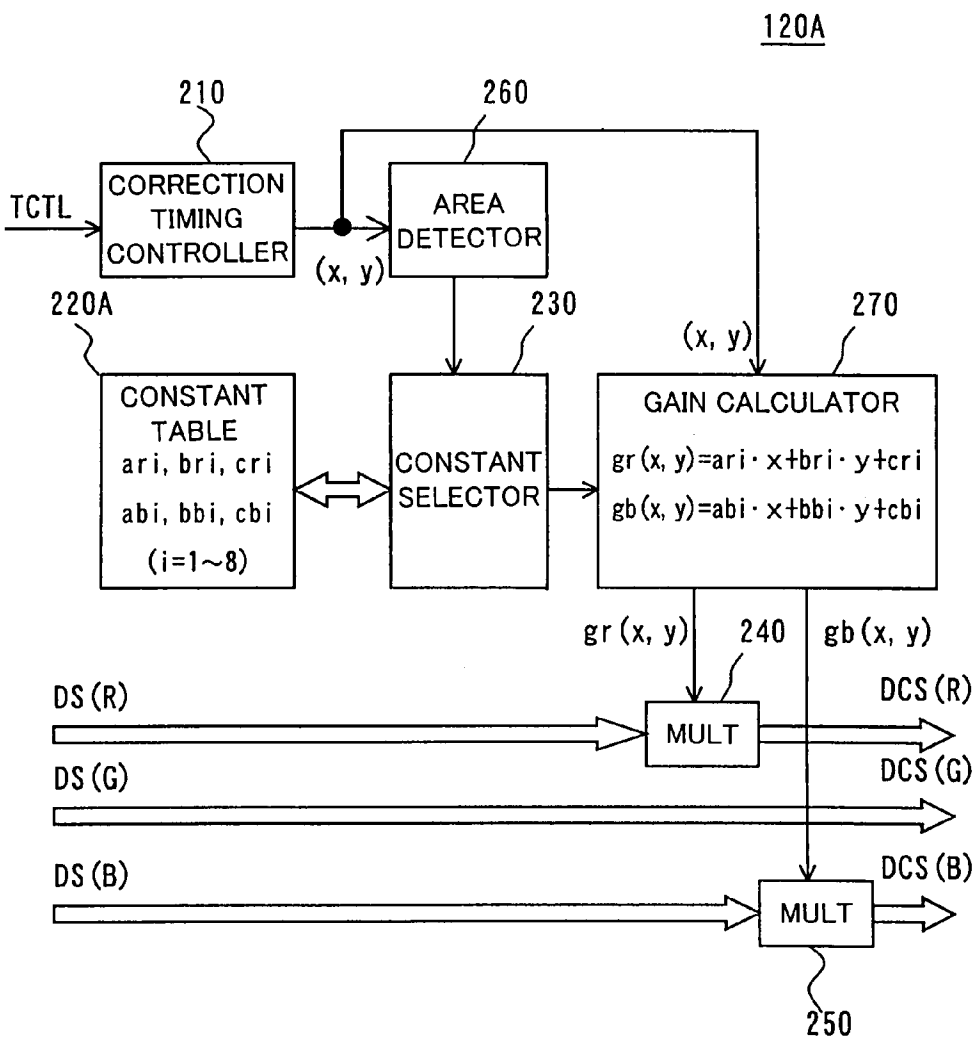
FIG. 4 is a block diagram schematically illustrating a gain corrector of an image display that is a second embodiment of this invention.

B. Second embodiment:

FIG. 4 is a block diagram schematically illustrating a gain corrector 120A of a second embodiment of this invention. An image display similar to that of the first embodiment can be configured by replacing the gain corrector 120 of the first embodiment with this gain corrector 120A.

The gain corrector 120A comprises a correction timing controller 210, a constant table 220A, a constant selector 230, a red multiplier 240, a blue multiplier 250, an area detector 260 and a gain calculator 270.

Figure 5:
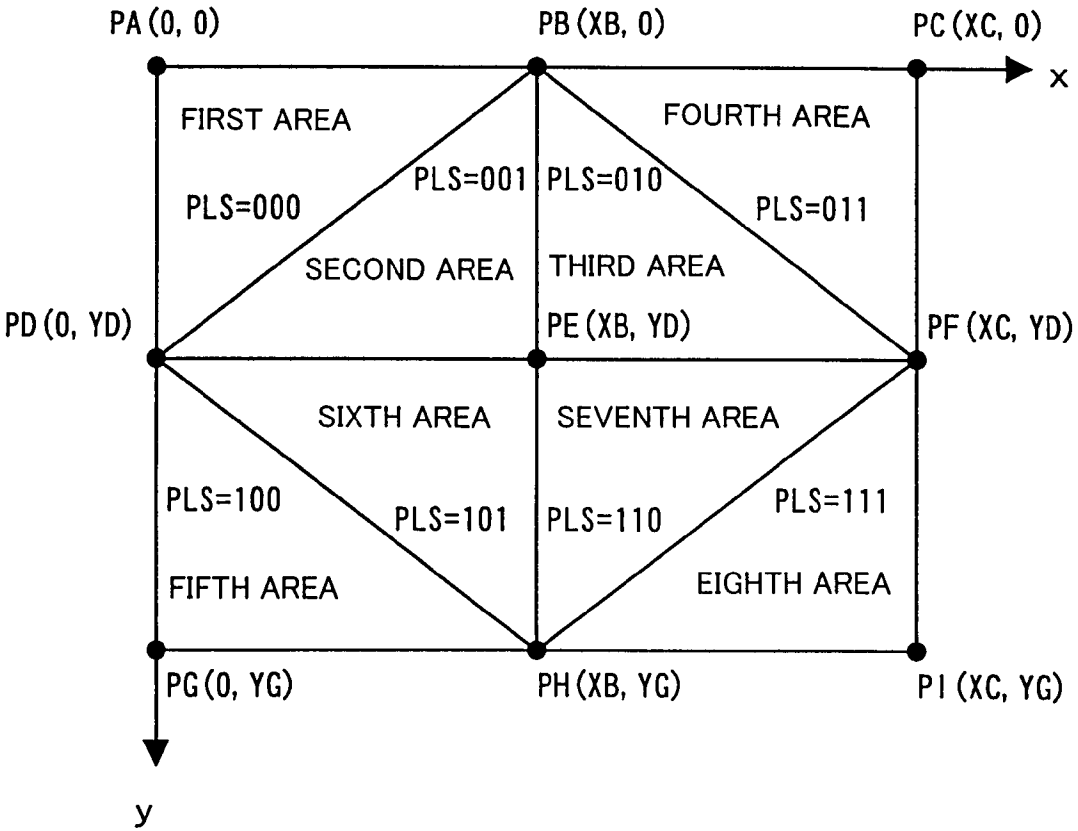
FIG. 5 shows division of areas.

The area detector 260 detects a segment (hereinafter called an "area" or "plane") that includes the pixel position (x, y) calculated by the correction timing controller 210. The meaning of "area" will be explained with reference to FIG. 5. Among multiple pixels arrayed in a matrix, designate those at the four corners as PA, PC, PG and PI, designate the center pixel as PE, designate the pixels at the left and right ends of the horizontal line passing through the center pixel PE as PD and PF, and designate the pixels at the upper and lower ends of the vertical line passing through the center pixel PE as PB and PH. Draw a vertical line connecting the pixels PB, PE and PH, draw a horizontal line connecting the pixels PD, PE and PF, and draw the sides of a rhombus having PB, PD, PH, and PF as apexes. This divides the matrix into eight right triangular regions (areas). Call the regions of the triangles PAPBPD, PBPEPD, PBPFPE, PBPCPF, PDPHPG, PDPEPH, PEPFPH and PFPIPH the first, second, third, fourth, fifth, sixth, seventh and eighth areas. Designate the positions of the pixels by coordinates (x, y) in a coordinate system whose vertical axis is y, horizontal axis is x, and origin is the pixel PA. In FIG. 5, the positions of the pixels PB, PC, PD, PE, PF, PG, PH are PI are defined as (XB, 0), (XC, 0), (0, YD), (XB, YD), (XC, YD), (0, YG), (XB, YG), (XC, YG).

The area detector 260 discriminates the area in which the pixel position (x, y) given by the correction timing controller 210 is present. The method of this discrimination will now be explained. As can be seen in FIG. 5, the pixel belongs to an area in the right half when x≧XB and to an area in the left half when x<XB. Further, the pixel belongs to an area in the lower half when y≧YD and to an area in the upper half when y<YD. Based on this, the area detector 260 discriminates that the area in which the pixel position (x, y) given by the correction timing controller 210 is present is the first or second area when x<XB and y<YD, is the third or fourth area when x≧XB and y<YD, is the fifth or sixth area when x<XB and y≧YD, and is the seventh or eighth area when x≧XB and y≧YD.

Figure 6A:
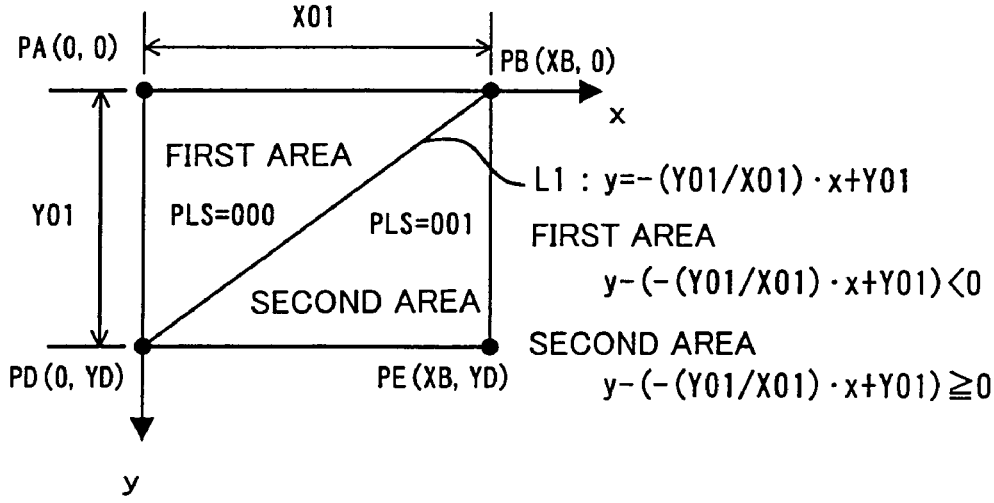
FIGS. 6(A) and 6(B) show conditions used to discriminate whether a pixel position (x, y) output by a correction timing controller 210 is present in a first area or a second area.
Figure 6B:
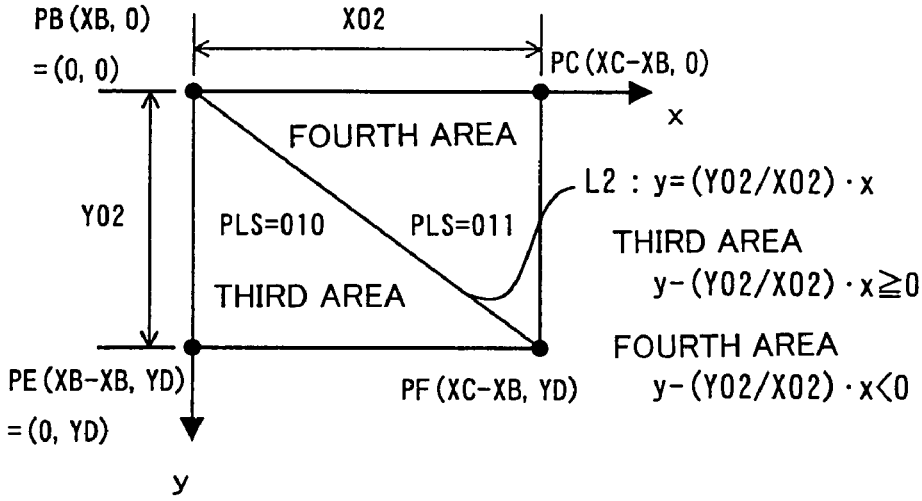

When the area detector 260 has discriminated that the pixel position (x, y) given by the correction timing controller 210 is located in the first or second area, it next discriminates which of these areas it is in. FIGS. 6(A) and 6(B) show conditions used to discriminate whether the area in which the pixel position (x, y) given by the correction timing controller 210 is present is the first area or the second area. When, as shown in FIG. 6(A), the number of pixels between pixel PA and pixel PB is defined as X01 (=XB−0) and the number of lines between pixel PA and pixel PD is defined as Y01 (=YD−0), the boundary line L1 between the first area and the second area can be represented by Equation (1):

$$y-\{-Y01/X01)\cdot x+Y01\}=0 \quad (1)$$

Equation (1) is therefore used to discriminate between the first area and the second area as shown by Equation (2a) and Equation (2b):

$$\text{First area: } y-\{-(Y01/X01)\cdot x+Y01\}<0 \quad (2a)$$

$$\text{Second area: } y-\{-(Y01/X01)\cdot x+Y01\}0 \quad (2b)$$

When the result of the discrimination is the first area, the area detector 260 outputs three bits of binary data PLS=000 (decimal number: 0) as area data PLS. When the result is the second area, it outputs area data PLS=001 (decimal number: 1).

Discrimination between the third area and fourth area is conducted as follows. As shown in FIG. 6(B), pixel PB is defined as the origin (0, 0). The number of pixels between pixel PB and pixel PC is defined as X02 (=YD−0) and the number of lines between pixel PB and pixel PE is defined as Y02 (=XC−XB−0). The boundary line L2 between the third area and the fourth area can then be represented by Equation (3):

$$y-(Y02/X02)\cdot x=0 \quad (3)$$

Equation (3) is therefore used to discriminate between the third area and the fourth area as shown by Equation (4a) and Equation (4b):

$$\text{Third area: } y-(Y02/X02)\cdot x\geqq 0 \quad (4a)$$

$$\text{Fourth area: } y-(Y02/X01)\cdot x<0 \quad (4b)$$

When the result of the discrimination is the third area, the area detector 260 outputs area data PLS=010 (decimal number: 2). When the result is the fourth area, it outputs PLS=011 (decimal number: 3).

Discrimination between the fifth area and the sixth area is carried out similarly to that between the third area and the fourth area while the pixel PD is used as the origin (0, 0). The number of pixels between pixel PD and pixel PE is defined as X03 (=XB−0) and the number of lines between pixel PD and pixel PG is defined as Y03 (=YG−YD−0). The discrimination is then made as shown by Equation (5a) and Equation (5b):

$$\text{Fifth area: } y-(Y03/X03)\cdot x\geqq 0 \quad (5a)$$

$$\text{Sixth area: } y-(Y03/X03)\cdot x<0 \quad (5b)$$

When the result of the discrimination is the fifth area, the area detector 260 outputs area data PLS=100 (decimal number: 4). When the result is the sixth area, it outputs PLS=101 (decimal number: 5).

Discrimination between the seventh area and the eighth area is carried out similarly to that between the first area and the second area. Specifically, pixel PE is defined as the origin (0, 0). The number of pixels between pixel PE and pixel PF is defined as X04 (=XC−XB−0) and the number of lines between pixel PE and pixel PH is defined as Y04 (=YG−YD−0). The discrimination is then made as shown by Equation (6a) and Equation (6b):

$$\text{Seventh area: } y-\{-(Y04/X04)\cdot x+Y04\}<0 \quad (6a)$$

$$\text{Eighth area: } y-\{-(Y04/X04)\cdot x+Y04\}\geqq 0 \quad (6b)$$

When the result of the discrimination is the seventh area, the area detector 260 outputs area data PLS=110 (decimal number: 6). When the result is the eighth area, it outputs PLS=111 (decimal number: 7).

The area detector 260 can thus detect the area including the pixel to be corrected in the foregoing manner.

Constants $ar_i$, $br_i$, $cr_i$, $ab_i$, $bb_i$ and $cb_i$ (i=1−8) for use in gain calculation by the gain calculator 270 are stored in the constant table 220A of FIG. 4 for each area.

The constant selector 230 receives the area data PLS indicating the area discriminated by the area detector 260, selects the corresponding constants $ar_i$, $br_i$, $cr_i$, $ab_i$, $bb_i$ and $cb_i$ from the constant table 220A, and supplies them to the gain calculator 270.

The gain calculator 270 determines the correction gain for every pixel in the discriminated area (segment pixel) by linear interpolation from the correction gains of the pixels at the area apexes (apex pixels).

Figure 7A:
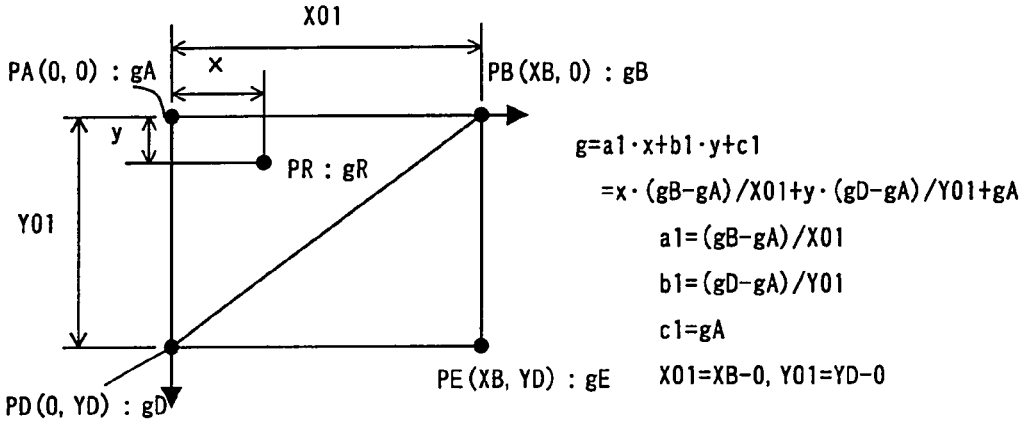
FIGS. 7(A) and 7(B) show gain calculation for pixels present in first and second areas conducted in a gain calculator 270.
Figure 7B:
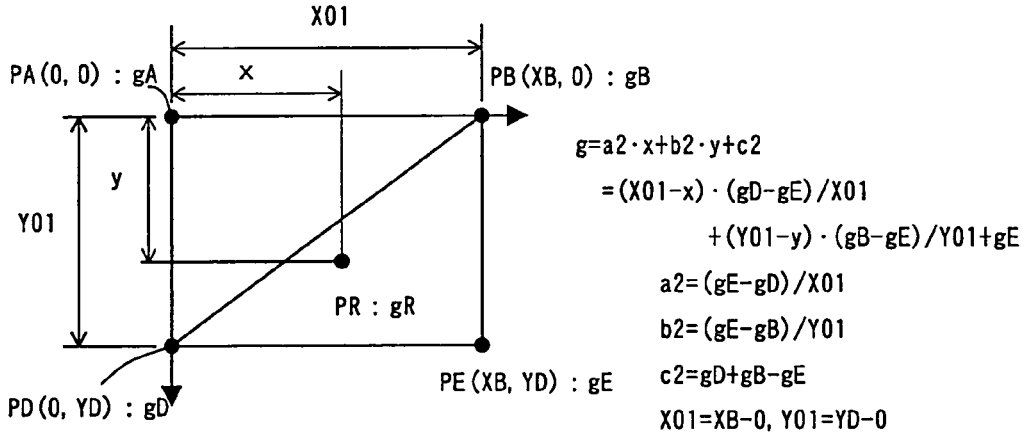

FIGS. 7(A) and 7(B) show the gain calculation for pixels present in the first and second areas conducted in the gain calculator 270. As shown in FIG. 7(A), the pixel PA is used as the origin (0, 0) and the correction gain g of an arbitrary pixel P(x, y) present in the first area is calculated by interpolation using Equation (7):

$$g=a1\cdot x+b1\cdot y+c1 \tag{7}$$

Defining the correction gains of the apex pixels PA, PB and PD as gA, gB and gD, the number of pixels between pixel PB and pixel PA as X01(=XB−0), and the number of lines between pixel PD and pixel PA as Y01(=YD−0), the constants a1, b1 and c1 can be represented by Equations (8a)–(8c):

$$a1=(gB-gA)/X01 \tag{8a}$$

$$b1=(gD-gA)/Y01 \tag{8b}$$

$$c1=gA \tag{8c}$$

Therefore, defining the red constants as ar1, br1 and cr1 and the blue constants as ab1, bb1 and cb1, it follows from Equation (7) that the equations for interpolating the red and blue correction gains gr and gb of an arbitrary pixel P(x, y) in the first area can be written:

$$gr=ar1\cdot x+br1\cdot y+cr1 \tag{9a}$$

$$gb=ab1\cdot x+bb1\cdot y+cb1 \tag{9b}$$

Defining the red correction gains of the apex pixels PA, PB and PD as gAr, gBr and gDr and defining the blue correction gains thereof as gAb, gBb and gDb, it follows from Equations (8a)–(8c) that the constants ar1, br1, cr1, ab1, bb1 and cb1 can be represented by Equations (10a)–(10f):

$$ar1=(gBr-gAr)/X01 \tag{10a}$$

$$br1=(gDr-gAr)/Y01 \tag{10b}$$

$$cr1=gAr \tag{10c}$$

$$ab1=(gBb-gAb)/X01 \tag{10d}$$

$$bb1=(gDb-gAb)/Y01 \tag{10e}$$

$$cb1=gAb \tag{10f}$$

The correction gains of the apex pixels PA, PB and PD can be obtained in advance using the correction gain determining procedure explained with regard to the first embodiment.

As shown in FIG. 7(B), defining pixel PA as the origin (0, 0), the correction gain g of an arbitrary pixel P present in the second area can be determined by interpolation using Equation (11):

$$g=a2\cdot x+b2\cdot y+c2 \tag{11}$$

Defining the correction gains of the apex pixels PB, PD and PE as gB, gD and gE, the constants a2, b2 and c2 can be represented by Equations (12a)–(12c):

$$a2=(gE-gD)/X01 \tag{12a}$$

$$b2=(gE-gB)/Y01 \tag{12b}$$

$$c2=gD+gB-gE \tag{12c}$$

Therefore, defining the red constants as ar2, br2 and cr2 and the blue constants as ab2, bb2 and cb2, it follows from Equation (11) that the equations for interpolating the red and blue correction gains gr and gb of an arbitrary pixel P(x, y) in the second area can be written:

$$gr=ar2\cdot x+br2\cdot y+cr2 \tag{13a}$$

$$gb=ab2\cdot x+bb2\cdot y+cb2 \tag{13b}$$

Defining the red correction gains of the apex pixels PB, PD and PE as gBr, gDr and gEr and defining the blue correction gains thereof as gBb, gDb and gEb, it follows from Equations (12a)–(12c) that the constants ar2, br2, cr2, ab2, bb2 and cb2 can be represented by Equations (14a)–(14f):

$$ar2=(gEr-gDr)/X01 \tag{14a}$$

$$br2=(gEr-gBr)/Y01 \tag{14b}$$

$$cr2=gDr+gBr-gEr \tag{14c}$$

$$ab2=(gEb-gDb)/X01 \tag{14d}$$

$$bb2=(gEb-gBb)/Y01 \tag{14e}$$

$$cb2=gDb+gBd-gEb \tag{14f}$$

The correction gains of the segment pixels in the other areas can also be determined by interpolation from the correction gains of the apex pixels of the area, similarly to what was explained with regard to the first and second areas. FIG. 8 is diagram showing examples of correction gain interpolation equations and constants stored in the constant table 220A for the respective areas. The interpolation equations and constants shown in FIG. 8 are non-limitative examples. They can be replaced by any of various other interpolation equations and constants usable for interpolating the correction gains of the segment pixels from the apex pixels of the respective areas.

The gain calculator 270 thus determines the correction gains gr and gb for every pixel and supplies them to the red multiplier 240 and the blue multiplier 250.

The gain corrector 120A corrects given image data DS(R), DS(G) and DS(B) and outputs them as image data DCS(R), DCS(G) and DCS(B). The image represented by the image data DCS corrected by the gain corrector 120A is formed on the liquid crystal panel 160. As a result, an image suppressed in color unevenness is displayed.

In the second embodiment, the gain corrector 120A corrects the red and blue image data among the image data of every pixel so as to make their levels substantially equal to the level of the green image data. The color unevenness tending to occur in the displayed image can therefore be suppressed. Moreover, in the second embodiment, the pixels are divided into multiple areas beforehand and the correction gain of any given pixel present in an area is determined by interpolation from the correction gains of the apex pixels of the area. This is advantageous in not requiring the correction gains of all pixels to be calculated in advance. It is also advantageous in that it simplifies the procedure for determining the correction gains in advance and reduces the size of the constant table for storing data corresponding to the determined correction gains.

Figure 9A:
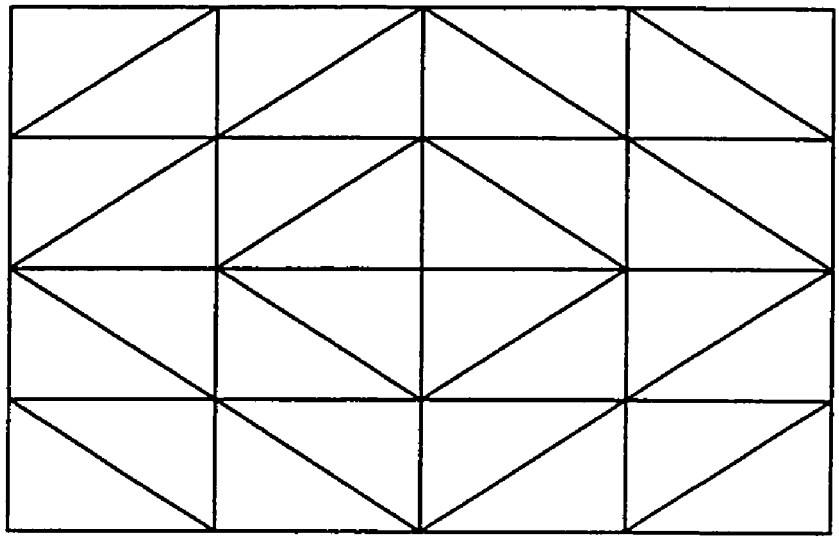
FIGS. 9(A) and 9(B) show other area division patterns.
Figure 9B:
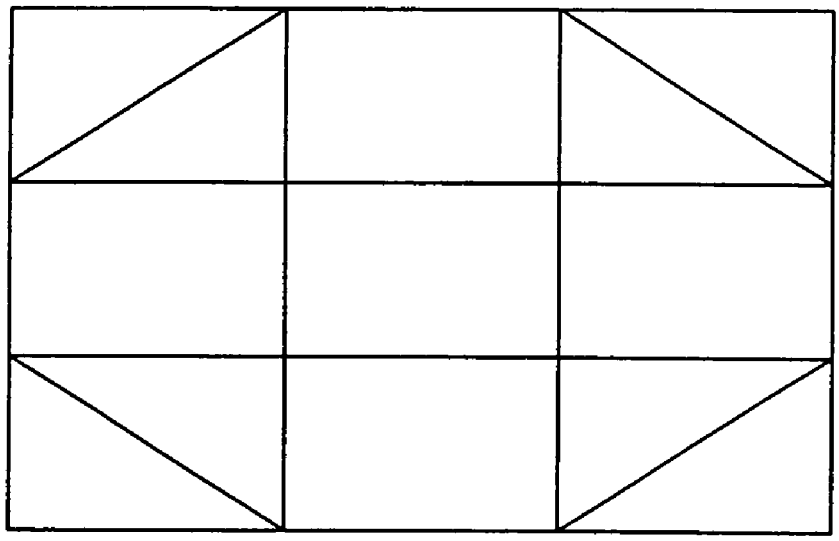
Figure 10:
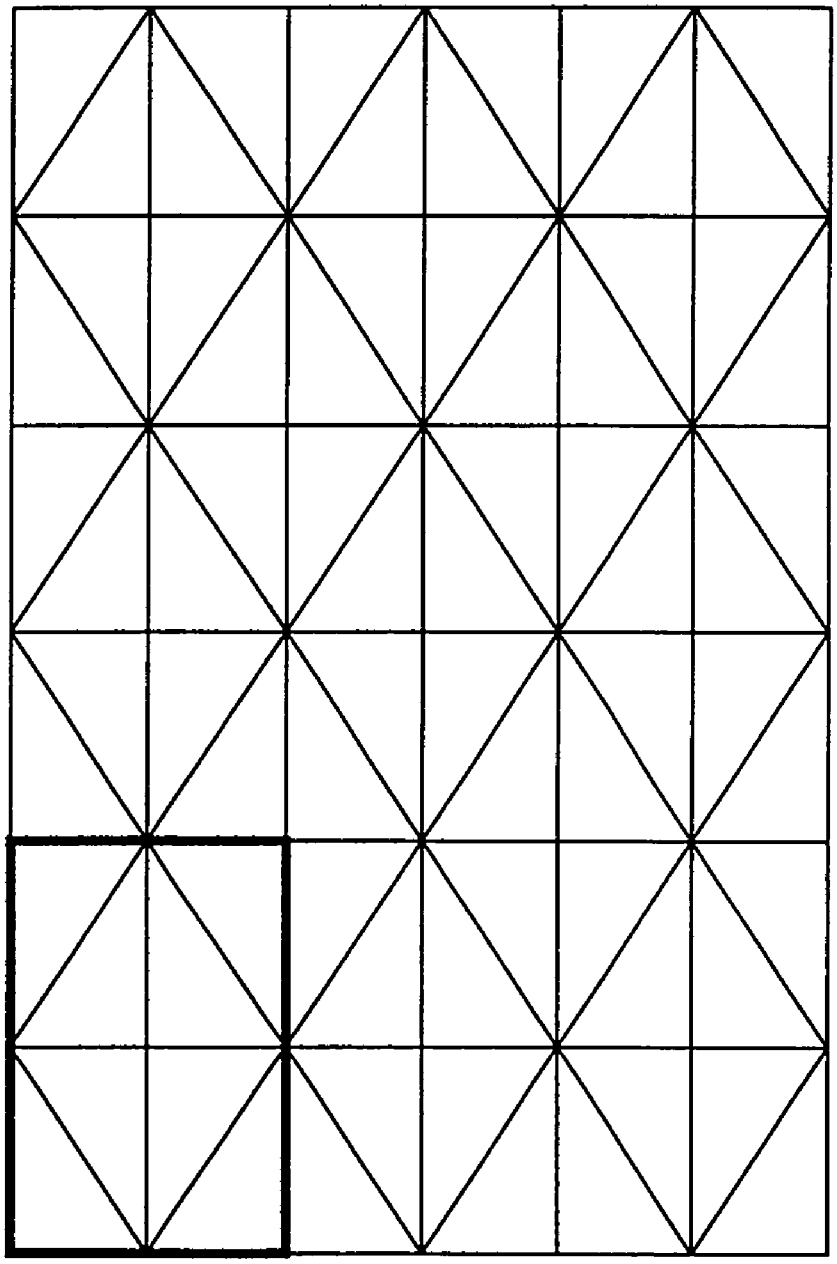
FIG. 10 shows still another area division pattern.

As shown in FIG. 5, the second embodiment defines the eight areas using the vertical line connecting pixels PB, PE and PH, the horizontal line connecting the pixels PD, PE and PF, and the sides of the rhombus having pixels PB, PD, PH and PF as its apexes. The distribution of color unevenness is generally such that the unevenness spreads radially outward from the image center toward the image periphery, and the area segmentation of the second embodiment is an example for coping with this distribution. However, the invention is not limited to this segmentation. For example, one of the segmentations shown in FIGS. 9 and 10 can be adopted. So long as the area segmentation is matched to the color unevenness distribution so as to enable the color unevenness within the areas to be suppressed by interpolation of pixel image data, it is not limited with respect to the number or shape of the segments. The area pattern illustrated in FIG. 10 is what is obtained by using the set of areas of FIG. 5 as a unit for dividing the image horizontally and vertically into multiple identical sets. As this pattern enables the correction processing to be conducted by repeating the same processing for each set, it makes the correction processing easier.

It is also possible to provide plural sets of the area detector 260 and the multiple gain calculator 270 for plural area segmentation patterns, provide means for selecting one set among them, and select an area segmentation pattern according to the color unevenness distribution characteristics of the display. By this, color unevenness can be suppressed with higher precision in accordance with various color unevenness characteristics arising in different displays.

The present invention is in no way limited to the details of the examples and embodiments described in the foregoing but various changes and modifications may be made without departing from the scope of the appended claims. For example, the following modifications are also possible.

(1) Although the foregoing embodiments were explained taking a projection display as an example, the invention can also be applied to a direct viewing display.

(2) Although the foregoing embodiments were explained taking an image display that uses a liquid crystal panel as an example, the invention is not limited in application to such a display but can also be applied to a display equipped with a PDM, DMD, CRT or any of various other display devices.

What is claimed is:

1. An image display apparatus, comprising:

an image processor for outputting image data including plural color component data, wherein the plural color component data includes red, blue and green color component data;

a gain corrector for correcting chromaticity levels of the image data output by the image processor; and an image display device having pixels each emitting a plurality of colored light rays for forming a color image in accordance with the corrected image data corrected by the gain corrector, wherein the gain corrector corrects a respective level of the red and blue color component data applied to each respective pixel in the image display device based on measured luminance levels at each respective pixel such that, when image data representing an image of a uniform color are output from the image processor, a difference in chromaticity of light exiting from the pixels due to characteristic differences between the pixels of the image display device is reduced without making uniform a luminance of the light exiting from the pixels of the image display device; and the gain corrector is configured to use the measured luminance level of green at each pixel as a reference level to reduce the difference in the chromaticity at each pixel.

2. An image display apparatus according to claim 1, wherein the gain corrector corrects the chromaticity levels of all but a specific one of the plural color component data applied to the pixels to reduce the difference in level between the specific color component data and the other color component data.

3. An image display apparatus according to claim 2, wherein the specific color component data is a color component data that makes a greatest contribution to the luminance of the light for forming the image.

4. An image display apparatus according to claim 3, wherein the plural color component data are red, green, and blue component data, and the specific color component data is the green component data.

5. An image display method, comprising:

providing image data including plural color component data, wherein the plural color component data includes red, blue, and green color component data;

correcting chromaticity levels of the image data; and producing light representing an image at pixels of an image display device, each pixel emitting a plurality of colored light rays for forming a color image in accordance with the corrected image data, wherein the correcting step comprises correcting a respective level of the red and blue color component data applied to each respective pixel in the image display device based on measured luminance levels at each respective pixel such that, when image data representing an image of a uniform color are output from the image processor, a difference in a chromaticity of light exiting from the pixels due to characteristic differences between the pixels of the image display device is reduced without making uniform a luminance of the light exiting from the pixels of the image display device; and the correcting step comprises using the measured luminance level of green at each pixel as a reference level to reduce the difference in the chromaticity at each pixel.

6. An image display method according to claim 5, wherein the step of correcting the level of at least one of the plural color component data includes the step of correcting the levels of all but a specific one of the plural color component data applied to the pixels to reduce difference in level between the specific color component data and the other color component data.

7. An image display method according to claim 6, wherein the specific color component data is a color component data that makes the a greatest contribution to the luminance of the light for forming the image.

8. An image display method according to claim 7, wherein the plural color component data are red, green, and blue component data, and the specific color component data is the green component data.

9. An image display apparatus, comprising:

an image processor for outputting image data including plural color component data;

a gain corrector for correcting chromaticity levels of the image data output by the image processor; and an image display device having a plurality of pixels from each of which light for forming an image exits in accordance with the corrected image data corrected by the gain corrector, wherein the gain corrector corrects the chromaticity level of at least one of the plural color component data applied to the plurality of pixels in accordance with respective positions of the plurality of pixels such that, when image data representing an image of a uniform color are output from the image processor, a difference in a chromaticity of light exiting from the plurality of pixels is reduced among the plurality of pixels, without making a luminance of the light exiting from the plurality of pixels of the image display device equal at each of the plurality of pixels;

the plurality of pixels are segmented into a plurality of triangular areas;

correction values for apex pixels corresponding to apexes of the plurality of triangular areas are determined in advance; and correction values of pixels other than the apex pixels in each of the plurality of triangular areas are interpolated from the correction values of respective apex pixels of each of the plurality of triangular areas.

10. An image display apparatus according to claim 9, wherein the gain corrector corrects the chromaticity levels of all but a specific one of the plural color component data applied to the plurality of pixels to reduce the difference in chromaticity level between the specific color component data and the other color component data.

11. An image display apparatus according to claim 10, wherein the specific color component data is a color component data that makes a greatest contribution to a luminance of the light for forming the image.

12. An image display apparatus according to claim 9, wherein the plurality of pixels are segmented into the plurality of triangular areas by a horizontal axis passing through a center pixel among the plurality of pixels, a vertical axis passing through the center pixel, and sides of a rhombus whose apexes are end points of the horizontal axis and the vertical axis.

13. An image display method, comprising:

providing image data including plural color component data;

correcting chromaticity levels of the image data; and producing light representing an image at a plurality of pixels of an image display device in accordance with the corrected image data, wherein the correcting step comprises correcting the level of at least one of the plural color component data applied to the plurality of pixels in accordance with respective positions of the plurality of pixels such that, when image data representing an image of a uniform color are output from the image processor, a difference in a chromaticity of light exiting from the plurality of pixels is reduced among the plurality of pixels, without making a luminance of the light exiting from the plurality of pixels of the image display device equal at each of the plurality of pixels;

the plurality of pixels are segmented into a plurality of triangular areas;

correction values for apex pixels corresponding to apexes of the plurality of triangular areas are determined in advance; and correction values of pixels other than the apex pixels in each of the plurality of triangular areas are interpolated from the correction values of respective apex pixels of each of the plurality of triangular areas.

14. An image display method according to claim 13, wherein the step of correcting the level of at least one of the plural color component data comprises:

correcting levels of all but a specific one of the plural color component data applied to the plurality of pixels to reduce the difference in level between the specific color component data and the other color component data.

15. An image display method according to claim 14, wherein the specific color component data is a color component data that makes the greatest contribution to a luminance of the light for forming the image.

16. An image display method according to claim 13, wherein the plurality of pixels are segmented into the plurality of triangular areas by a horizontal axis passing through a center pixel among the plurality of pixels, a vertical axis passing through the center pixel, and sides of a rhombus whose apexes are end points of the horizontal axis and the vertical axis.

17. An image display apparatus, comprising:

an image processor for outputting image data including plural color component data, wherein the plural color component data includes red, blue, and green color component data;

a gain corrector for correcting chromaticity levels of the image data output by the image processor; and an image display device having a plurality of pixels each emitting a plurality of colored light rays for forming a color image in accordance with the corrected image data corrected by the gain corrector;

wherein the gain corrector corrects the level of the red and blue color component data applied to the pixels in accordance with the positions of the pixels such that, when image data representing an image of a uniform color are output from the image processor, a difference in chromaticity of light exiting from the pixels due to characteristic differences between the pixels of the image display device is reduced without making luminance of the light exiting from the pixels of the image display device conform to a desired smooth luminance profile throughout the image display device and without making uniform the luminance of the light exiting from the pixels of the image display device; and the gain corrector is configured to use the measured luminance level of green at each pixel as a reference level to reduce the difference in the chromaticity at each pixel.

18. The image display apparatus of claim 17, wherein the gain corrector corrects the chromaticity levels of all but a specific one of the plural color component data applied to the pixels to reduce the difference in level between the specific color component data and the other color component data.

19. The image display apparatus of claim 18, wherein the specific color component data is a color component data that makes a greatest contribution to the luminance of the light for forming the image.

20. The image display apparatus of claim 19, wherein the plural color component data are red, green, and blue component data, and the specific color component data is the green component data.

21. The image display apparatus of claim 17, wherein the plurality of pixels are segmented into a plurality of small areas of polygonal shape;

correction values for apex pixels corresponding to apexes of the small areas are determined in advance; and correction values of pixels other than the apex pixels in each small area are interpolated from the correction values of the apex pixels of each small area.

22. The image display apparatus of claim 21, wherein the plurality of pixels are segmented into the plurality of small areas by a horizontal axis passing through a center pixel among the multiple pixels, a vertical axis passing through the center pixel, and defining the sides of a rhombus whose apexes are the extremities of the horizontal and vertical axis.

23. An image display method, comprising:

providing image data including plural color component data, wherein the plural color component data includes red, blue, and green color component data;

correcting chromaticity levels of the image data; and producing light representing an image at pixels of an image display device, each pixel emitting a plurality of colored light rays for forming a color image in accordance with the corrected image data, wherein the correcting sep comprises correcting the level of the red and blue color component data applied to the pixels in accordance with respective positions of the pixels such that, when image data representing an image of a uniform color are output from the image processor, a difference in a chromaticity of light exiting from the pixels due to characteristic differences between the pixels of the image display device is reduced without making a luminance of the light exiting from the pixels of the image display device conform to a desired smooth luminance profile throughout the image display device and without making uniform the luminance of the light exiting from the pixels of the image display device; and the correcting step comprises using the measured luminance level of green at each pixel as a reference level to reduce the difference in the chromaticity at each pixel.

24. The image display method of claim 23, wherein the step of correcting the level of at least one of the plural color component data includes the step of correcting the levels of all but a specific one of the plural color component data applied to the pixels to reduce difference in level between the specific color component data and the other color component data.

25. The image display method of claim 23, wherein the specific color component data is a color component data that makes the a greatest contribution to the luminance of the light for forming the image.

26. The image display method of claim 25, wherein the plural color component data are red, green, and blue component data, and the specific color component data is the green component data.

27. The image display method of claim 23, wherein the plurality of pixels are segmented into a plurality of small areas of polygonal shape;

correction values for apex pixels corresponding to apexes of the small areas are determined in advance; and correction values of pixels other than the apex pixels in each small area are interpolated from the correction values of the apex pixels of each small area.

28. The image display method of claim 27, wherein the plurality of pixels are segmented into the plurality of small areas by a horizontal axis passing through a center pixel among the multiple pixels, a vertical axis passing through the center pixel, and defining the sides of a rhombus whose apexes are the extremities of the horizontal axis and the vertical axis.

* * * * *